United States Patent [19]

Freiberg

[11] Patent Number: 5,048,429

[45] Date of Patent: Sep. 17, 1991

[54] UNIVERSAL SHELVING

[76] Inventor: Dan L. Freiberg, 1311 190th St., State Center, Iowa 50247

[21] Appl. No.: 428,786

[22] Filed: Oct. 30, 1989

[51] Int. Cl.[5] ..... A47B 9/00

[52] U.S. Cl. ..... 108/106; 108/111

[58] Field of Search ..... 108/106, 107, 144, 111, 108/91, 96; 221/187, 190, 207

[56] References Cited

U.S. PATENT DOCUMENTS

| | | | |
|---|---|---|---|
| 909,336 | 1/1909 | Riedy | 108/108 X |
| 911,567 | 2/1909 | Berkowitz | 108/106 |
| 1,044,889 | 10/1912 | Hyde | 108/106 |
| 1,689,064 | 9/1928 | Fritz, Jr. | 108/106 |
| 2,364,003 | 11/1944 | Scruggs | 108/106 |
| 2,892,547 | 6/1959 | Whitaker | 108/106 |
| 3,104,626 | 9/1963 | Brunette | 108/106 |
| 3,173,385 | 3/1965 | Tucker | 108/106 |
| 3,465,098 | 9/1969 | Klein | 108/91 |
| 3,506,138 | 4/1970 | Travis | 108/91 |
| 4,149,473 | 7/1979 | Lundquvist | 108/106 X |
| 4,302,023 | 11/1981 | Kiesz | 108/106X |

*Primary Examiner*—JoséV. Chen

*Attorney, Agent, or Firm*—Zarley, McKee, Thomte, Voorhees & Sease

[57] ABSTRACT

A universal shelving unit is provided with opposite pairs of legs having a cross brace extending between each pair of legs. Support brackets are slidably mounted on the legs for supporting longitudinal braces extending between corresponding legs in each pair of legs. A shelf is positioned on the longitudinal braces. Additional support brackets, longitudinal braces and shelves can be positioned anywhere along the length of the legs. Leg extensions can be provided to further extend the length of the legs. The shelf unit can be extended linearly or at right angles by the use of additional legs, cross braces and support brackets. The length and spacing between shelves is adjustable and the depth is selectable.

11 Claims, 3 Drawing Sheets

UNIVERSAL SHELVING

BACKGROUND OF THE INVENTION

Conventional shelving is normally constructed with premanufactured materials which dictate the spacing between the shelves as well as the length of the shelving. The height of conventional shelving is also limited to the height of the pre-manufactured legs. Also, conventional shelving does not allow the shelves to be extended, other than by constructing a separate and independent shelf structure.

Accordingly, a primary objective of the present invention is the provision of an improved shelf structure.

Another objective of the present invention is the provision of a shelf structure which permits the spacing between the shelves to be adjusted anywhere along the length of the leg.

Still another objective of the present invention is the provision of shelf framing which permits the length of the shelves to be selected as needed.

Yet another objective of the present invention is the provision of a shelving unit onto which additional extended shelving units can be easily added.

Another objective of the present invention is the provision of universal shelving which is economical to manufacture and durable in use.

These and other objectives will become apparent from the following description of the invention.

SUMMARY OF THE INVENTION

Universal shelving is provided including first and second pairs of legs with a cross brace extending between the respective pairs of legs. Shelf brackets are slidably received on each leg for supporting longitudinal braces, which in turn support the shelf. The brackets are fixed in position on the legs by set screws. Thus, the shelves can be positioned anywhere along the length of the leg. Dimension 2×4 lumber and plywood is used to construct the longitudinal braces and shelves. Also, with the use of additional legs and support brackets, the shelving can be extended longitudinally or at right angles.

The height of the legs, and thus the shelving, can also be extended by the use of leg extensions attached to each leg. The legs and leg extensions have mating male and female ends for connecting the leg and leg extensions together.

DETAILED DESCRIPTION OF THE DRAWINGS

Figure 1:
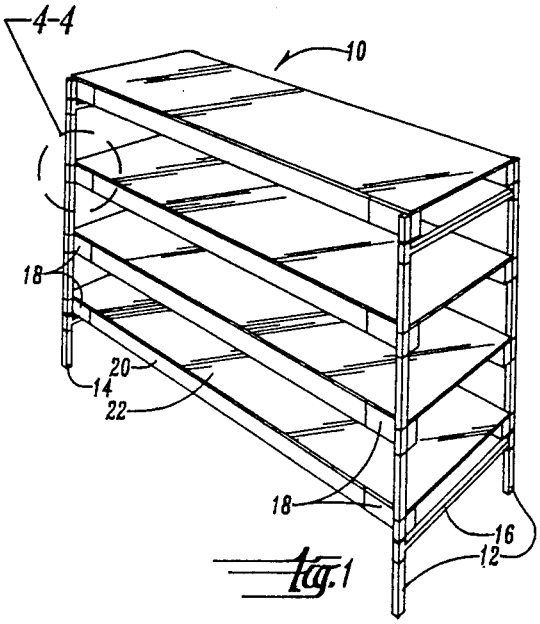
FIG. 1 is a perspective view of the shelf structure of the present invention.

The basic shelf unit of the present invention is designated by the reference numeral 10, as seen in FIG. 1. This shelf structure includes first and second pairs of legs 12 and 14, with a cross brace 16 extending between the respective pairs of legs. Shelf structure 10 also includes support brackets 18 mounted on each leg, with a longitudinal brace 20 extending between corresponding brackets. The shelves 22 are supported by the longitudinal braces 20.

Figure 11:
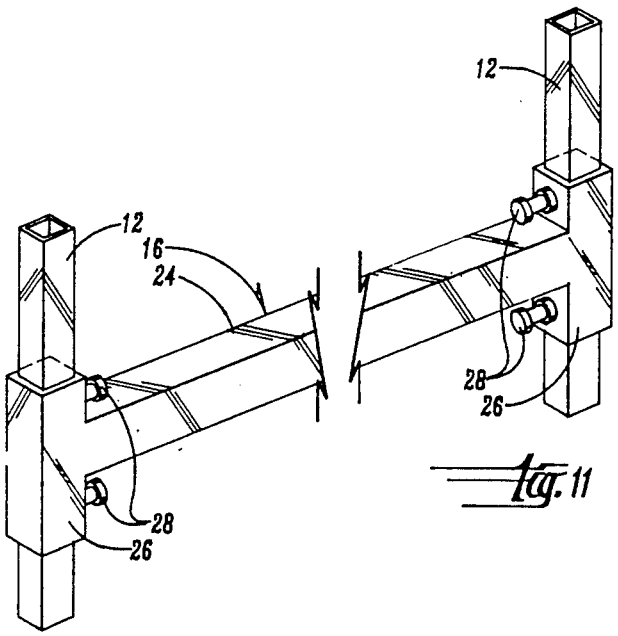
FIG. 11 is a perspective view of the cross brace of the shelf structure.

Each cross brace 16 includes an arm 24 with a collar 26 connected to each end of the arm by welding or the like, as seen in FIG. 11. The collars are slidably received on the legs so that the cross brace 16 can be positioned anywhere along the length of the legs. At least one set screw 28 is provided on each collar 26 for fixing the position of cross brace 16 on the legs.

Figure 4:
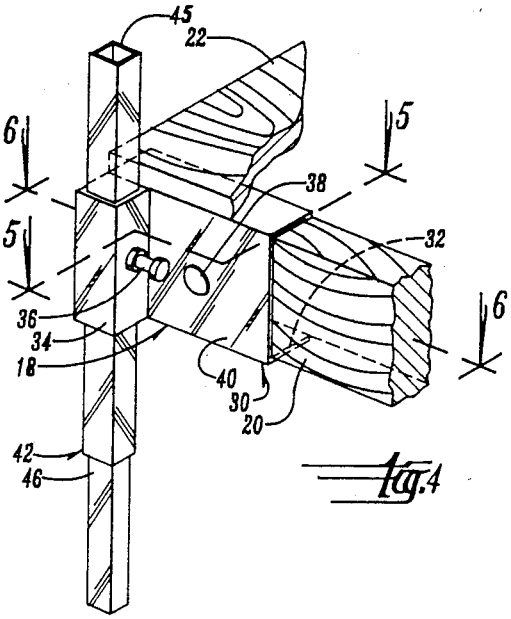
FIG. 4 is a partial sectional perspective view taken along lines 4—4 of FIG. 1.
Figure 5:
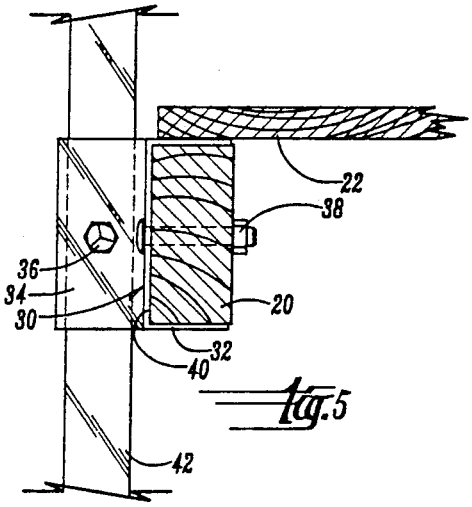
FIG. 5 is a partial sectional view taken along lines 5—5 of FIG. 4.
Figure 6:
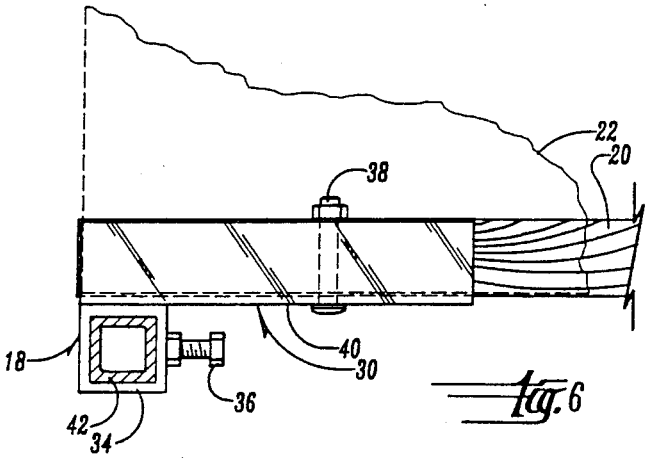
FIG. 6 is a partial sectional view taken along lines 6—6 of FIG. 4.

The construction of the support brackets 18 is shown in FIGS. 4, 5 and 6. Each bracket 18 includes a C-shaped support member 30, with a lower leg 32 for supporting the longitudinal brace 20. While the support member shown to be C-shaped, it is understood that the member could also be L-shaped with a lower leg to support the longitudinal brace. A collar 34 is attached to support member 30 by welding or the like and is slidably received over the respective leg such that the bracket 18 can be positioned anywhere along the length of the leg. A set screw 36 fixes the position of bracket 18 on the leg. A nut and bolt assembly 38 extends through the face 40 of the support member 30 so as to secure the longitudinal brace 20 thereto. Thus, the support brackets 18 can be positioned anywhere along the legs such that the spacing between shelves 22 is adjustable to accommodate small, large or bulky items. The top shelf can also be positioned so as to serve as a workbench, if desired.

Figure 7:
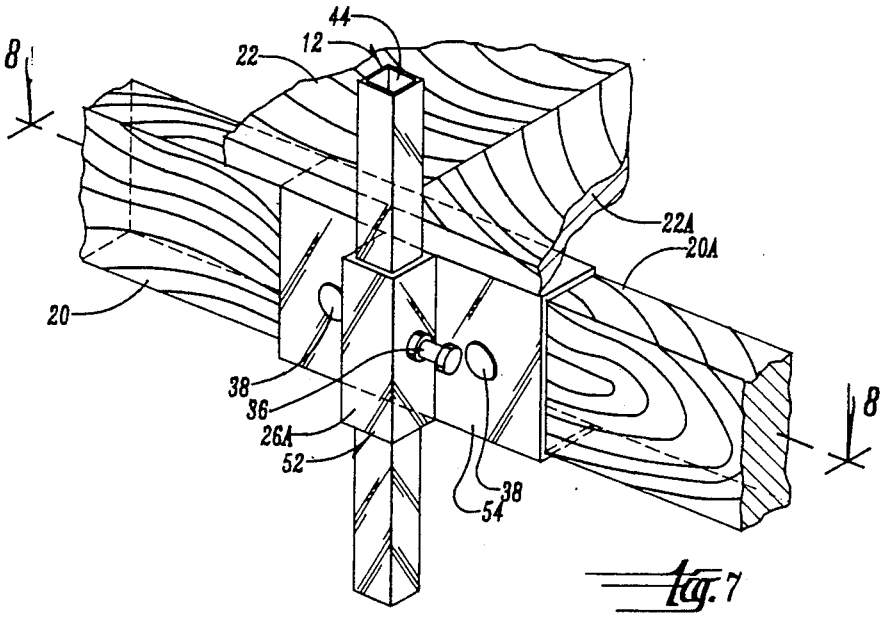
FIG. 7 is a partial sectional perspective view taken along lines 7—7 of FIG. 2.

The height of the legs can be increased by the use of leg extensions 42. Preferably, the legs are formed of square steel tubing so as to have a female upper end 44, as seen in FIG. 7. The leg extension has a male lower end 46, shown in FIG. 4, which is matingly received within the female end 44 of the leg. The dimension of leg extension 42 above the male end 46 is the same as the dimensions of the legs, so that cross braces 16 and support brackets 18 can be slidably positioned on the leg extensions 42. Also, the leg extensions 42 have an upper female end 45 so that additional leg extensions 42 can be added to other leg extensions.

Figure 2:
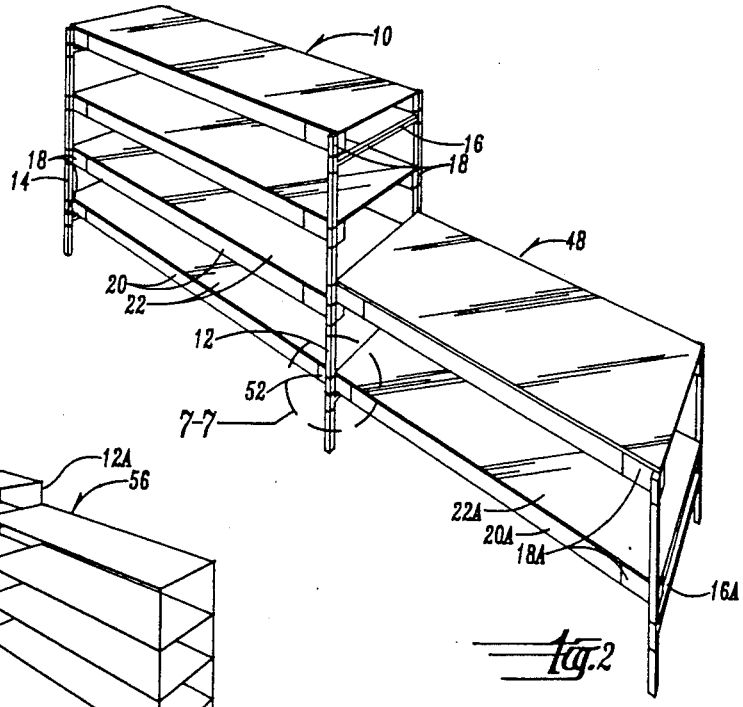
FIG. 2 is a perspective view of an extended shelf structure to the present invention.
Figure 8:
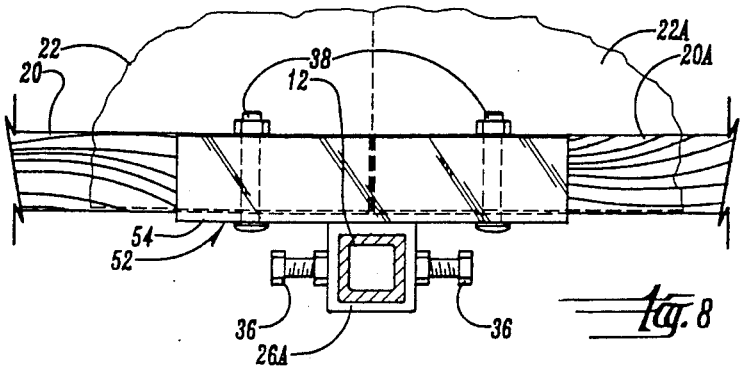
FIG. 8 is a partial sectional view taken along lines 8—8 of FIG. 7.

A shelf extension 48 can be added on to the basic shelf unit 10, as seen in FIG. 2. The extended shelf includes a third set of legs 50 with a cross brace 16A and support brackets 18A which are offset with respect to brackets 18 on shelf unit 10. As seen in FIGS. 2, 7 and 8, the shelf 22A can be set at the same height as a shelf 22 on unit 10 by use of a center support bracket 52. Center support bracket 52 is similar in construction to brackets 18, except that support member 54 extends on both sides of collar 26A, as opposed to the support member 30 which extends in only one direction from collar 26. Thus, support member 54 is adapted to support the longitudinal brace 20 on the base shelf unit 10 and the longitudinal brace 20A on the shelf extension 48.

Figure 3:
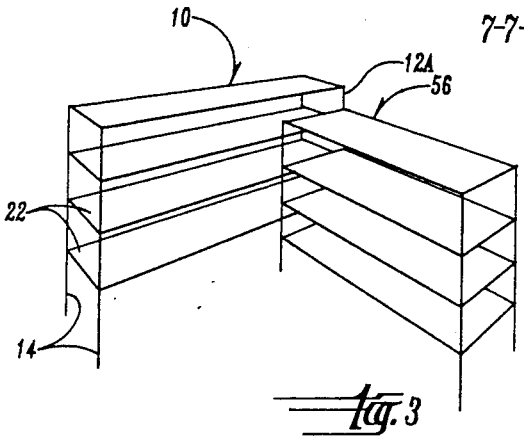
FIG. 3 is a schematic perspective view of an alternative embodiment of the extended shelf structure.
Figure 9:
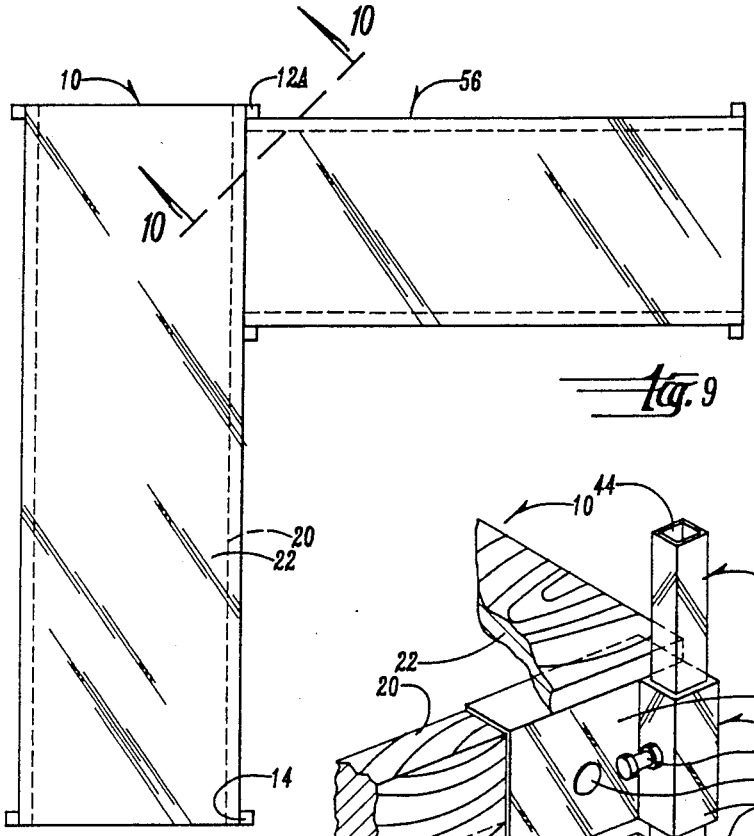
FIG. 9 is a plan view of the shelf structure shown in FIG. 3.
Figure 10:
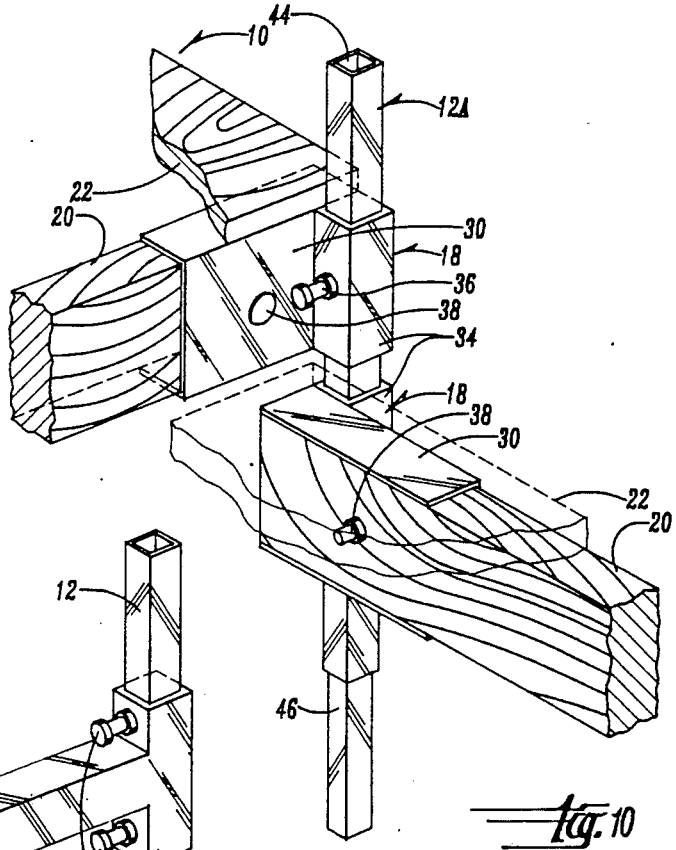
FIG. 10 is a partial sectional view taken along lines 10—10 of FIG. 9.

A right angle shelf extension 56 can also be added to shelf unit 10, as seen in FIGS. 3, 9 and 10. Right angle unit 56 has the same basic construction as unit 10. Shelf unit 10 and shelf extension 56 share one leg 12A. as seen in FIGS. 9 and 10.

On a long shelf which is to support heavy items, additional legs with support brackets having center support member 54 can be positioned between legs 12 and 14 to provide additional support to longitudinal braces 20. Such structure is similar to the structure shown in FIG. 7 except that the longitudinal braces 20 and 20A comprise a single elongated brace.

Preferably, the legs and leg extensions are made of 1¼ inch 14 gauge square steel tubing. The legs and leg extensions can be made in any desired length, such as 4 or 6 foot lengths for the legs and 2 foot lengths for the extensions. The cross braces 16 and support brackets 18 are preferably made of 14 gauge steel. The longitudinal braces can be made with dimensional lumber, such as 2×4, cut to any desired length. Shelves 22 can be made from plywood, pressed board or the like, cut to the desired length and width. The support brackets can be slid anywhere along the legs or leg extensions such that the shelves can be spaced apart as desired. Also, the adjustable brackets permit the shelves to be leveled, even though the legs do not sit upon a level surface.

Cross braces 16 can be manufactured in various lengths, such that the depth of shelf unit 10 can be varied as desired. For example, cross brace length of 18 inches, 24 inches and 30 inches accommodate various sized items to be shelved.

Thus, with the legs, leg extensions, cross braces and support brackets of the present invention, shelves can be constructed having any length, with any desired spacing or height between shelves, and with selected shelf depth. Linear or right angle extensions can be easily added to the shelf unit.

From the foregoing, it is seen that the present invention accomplishes at least all of the stated objectives.

What is claimed is:

1. A shelving structure comprising:

first and second pairs of vertical legs;

first and second cross braces extending between the first and second pairs of legs, respectively;

means for adjustably securing the cross braces to the legs such that the cross braces are vertically adjustable along the legs;

a first pair of longitudinal braces extending between corresponding legs of the first and second pairs of legs;

bracket means slidably received on each leg for adjustably securing the longitudinal braces to the legs, each bracket means including a C-shaped support member for supporting and receiving a respective end of the longitudinal braces, a collar fixed on the support member and being slidably received on the leg, and a set screw extending through the collar for frictionally engaging the leg so as to hold the bracket and longitudinal brace in position on the leg; and a shelf supported on the longitudinal braces.

2. The structure of claim 1 wherein the means for securing the cross braces includes a collar at each end of each cross brace, the collars being slidably received on the respective legs, and a set screw extending through each collar for frictionally engaging the legs so as to hold the collars and cross brace in position on the legs.

3. The structure of claim 1 further comprising a leg extension mounted on each leg so as to extend the height of the leg.

4. The structure of claim 3 wherein each leg and leg extension having mating male and female ends for joining the leg and leg extension together.

5. The structure of claim 3 further comprising a second pair of longitudinal braces extending between corresponding leg extensions at a location above the first set of longitudinal braces, and bracket means slidably received on the leg extensions for adjustably securing the second pair of longitudinal braces to the leg extensions.

6. The structure of claim 5 wherein the bracket means for securing the second pair of longitudinal braces includes a support member for supporting the respective end of the longitudinal braces, a collar fixed on the support member and being slidably received on the leg extension, and a set screw extending through the collar for frictionally engaging the leg extension so as to hold the collar, support member and longitudinal brace in position on the leg extension.

7. The structure of claim 1 further comprising a third pair of legs spaced apart from the second pair of legs, a third cross brace extending between the third pair of legs, means for adjustably securing the third pair of cross braces to the legs such that the third cross brace is adjustable along the legs; an additional pair of longitudinal braces extending between corresponding legs of the second and third pair of legs, bracket means slidably received on the second and third pair of legs for adjustably securing the additional pair of longitudinal braces to the legs, and a shelf supported on the additional pair of longitudinal braces.

8. The shelving structure of claim 1 wherein the C-shaped support member of the bracket means includes horizontally disposed upper and lower arms and a vertically disposed web interconnecting the arms so as to define a recess for receiving the longitudinal brace.

9. The shelving structure of claim 8 wherein the recess is laterally open so as to receive the longitudinal brace from a horizontal disposition.

10. The shelving structure of claim 9 wherein the support member of the bracket is offset with respect to the leg such that the longitudinal brace may extend at least to the vertical center-line of the leg.

11. The shelving structure of claim 8 wherein the support member of the bracket is offset with respect to the leg such that the longitudinal brace may extend at least to the vertical center-line of the leg.

* * * * *